US007385474B2

(12) United States Patent
Kawanishi

(10) Patent No.: US 7,385,474 B2
(45) Date of Patent: Jun. 10, 2008

(54) THERMOSENSOR, THERMOPROTECTOR, AND METHOD OF PRODUCING A THERMOSENSOR

(75) Inventor: Toshiro Kawanishi, Osaka (JP)

(73) Assignee: Uchihashi Estec Co., Ltd. (JP)

( * ) Notice: Subject to any disclaimer, the term of this patent is extended or adjusted under 35 U.S.C. 154(b) by 334 days.

(21) Appl. No.: 11/194,927

(22) Filed: Aug. 2, 2005

(65) Prior Publication Data

US 2006/0028315 A1 Feb. 9, 2006

(30) Foreign Application Priority Data

Aug. 4, 2004 (JP) ..... 2004-227765

(51) Int. Cl.
*H01H 85/36* (2006.01)
*H01H 85/044* (2006.01)

(52) U.S. Cl. ..... 337/142; 337/407; 337/414

(58) Field of Classification Search ..... 337/4, 337/401, 405–407, 147, 148, 152
See application file for complete search history.

(56) References Cited

U.S. PATENT DOCUMENTS 530,430 A * 12/1894 Klein ..... 337/403
2,790,049 A * 4/1957 McAlister ..... 337/405
3,198,914 A * 8/1965 Baran et al. ..... 337/405
3,420,217 A * 1/1969 Powell et al. ..... 123/198 D
3,638,083 A * 1/1972 Dornfeld et al. ..... 361/321.1
3,780,327 A * 12/1973 Vervaart et al. ..... 313/151
4,383,236 A * 5/1983 Urani et al. ..... 337/403
4,441,093 A * 4/1984 Okazaki ..... 337/404
4,536,641 A * 8/1985 Chan ..... 219/253
5,192,937 A * 3/1993 Lee ..... 337/104
5,280,262 A * 1/1994 Fischer ..... 337/405
5,363,083 A * 11/1994 Fischer ..... 337/407
5,600,295 A * 2/1997 Kaufmann ..... 337/405
5,612,662 A * 3/1997 Drekmeier et al. ..... 337/389
5,770,993 A * 6/1998 Miyazawa et al. ..... 337/160
5,793,274 A * 8/1998 Kelly et al. ..... 337/183
5,896,080 A * 4/1999 Chen ..... 337/407
6,204,747 B1 * 3/2001 Kitchens ..... 337/407
6,342,827 B1 * 1/2002 Buhrend et al. ..... 337/365
6,348,851 B1 * 2/2002 Wyser et al. ..... 337/411
7,023,674 B2 * 4/2006 Gross et al. ..... 361/23

FOREIGN PATENT DOCUMENTS

GB 2077500 A * 12/1981
JP 01057546 A * 3/1989
JP 7-29481 1/1995
WO WO 8702835 A1 * 5/1987

* cited by examiner

*Primary Examiner*—Anatoly Vortman
(74) *Attorney, Agent, or Firm*—Lucas & Mercanti, LLP

(57) ABSTRACT

In the thermosensor of the invention, both ends 21, 22 of an elastic member 2 are fixed to a body 1 in a state where the elastic member 2 is compressed in a longitudinal direction, to form the elastic member 2 into a convex curved shape, one end side of the convex curved shape is raised by a predetermined angle θL' with respect to the body 1, a flexure angle of another end 22 of the convex curved shape is zero, the fixation of one end portion 21 of the elastic member 2 and the body 1 is conducted via a fusible material 3, and a melting point or a softening point of the fusible material 3 is an operating temperature.

56 Claims, 12 Drawing Sheets

Fig.7－1A
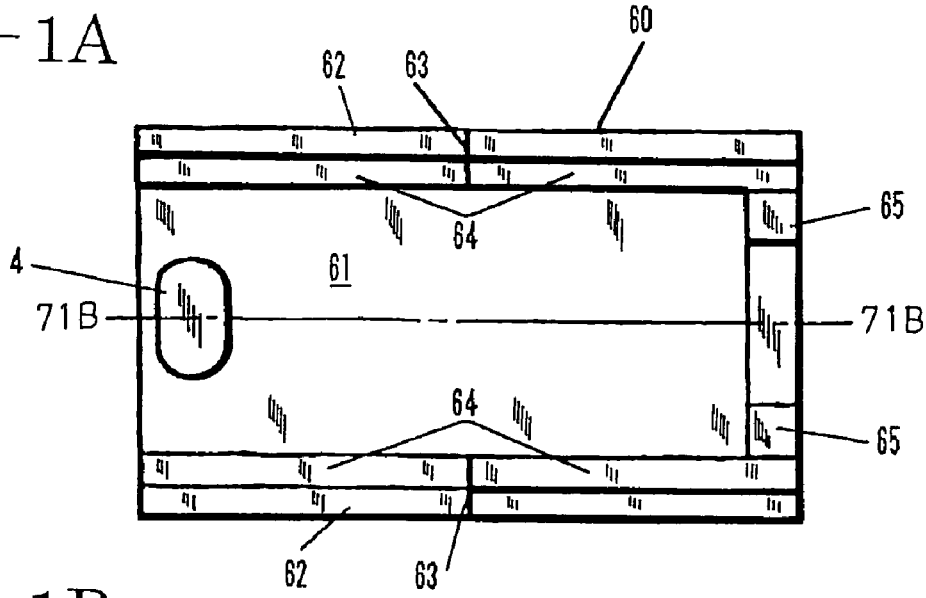
Fig.7－1B
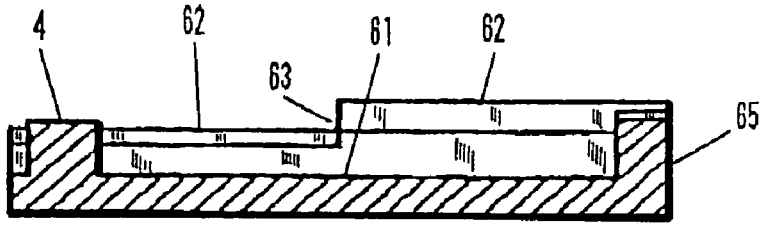
Fig.7－1C
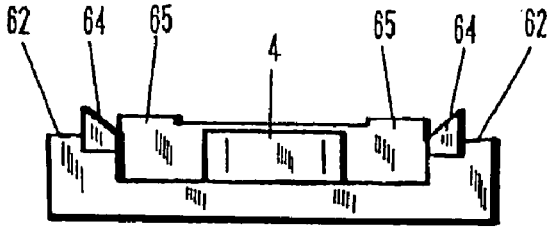
Fig.7－1D
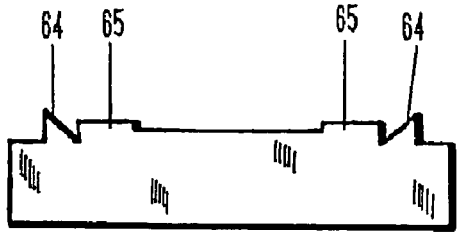

Fig.7—2A
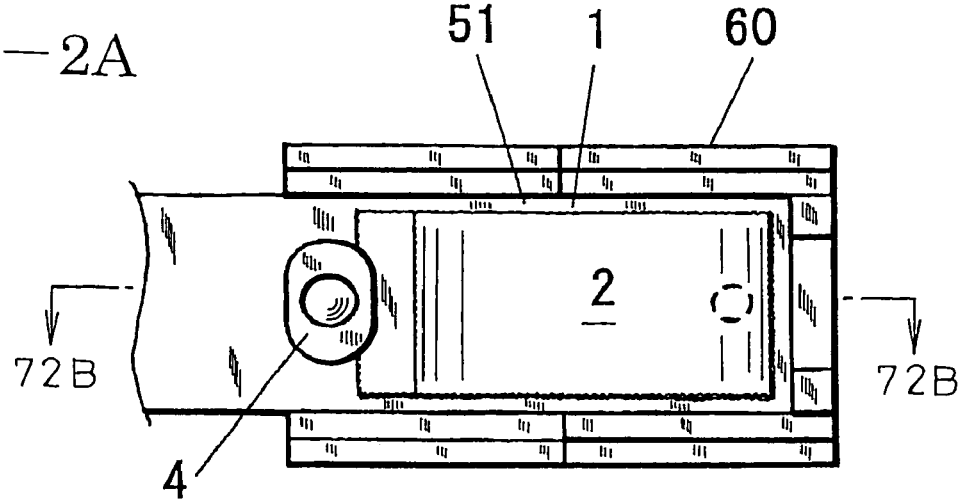
Fig.7—2B
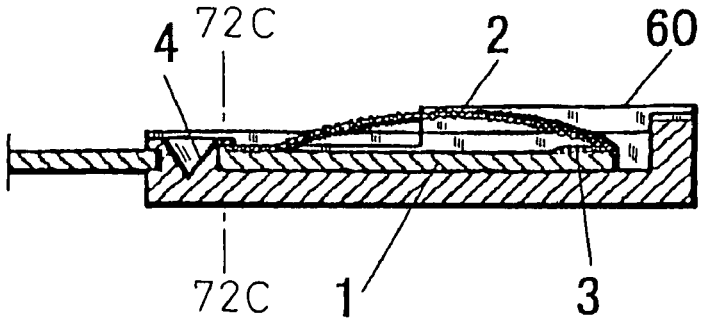
Fig.7—2C
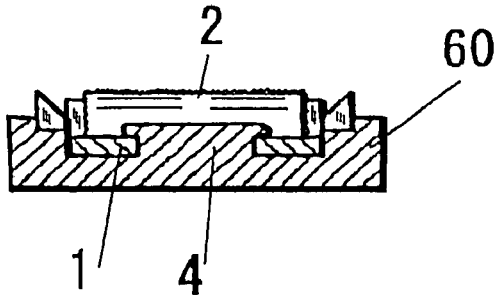

Fig.7—3
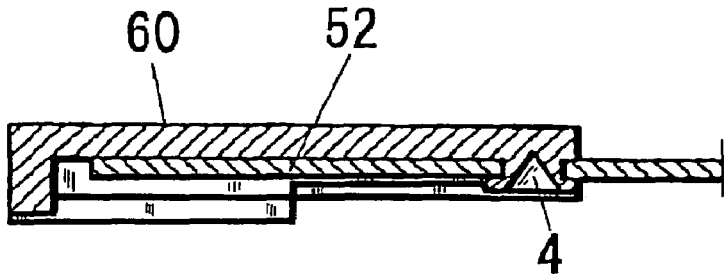
Fig.7—4
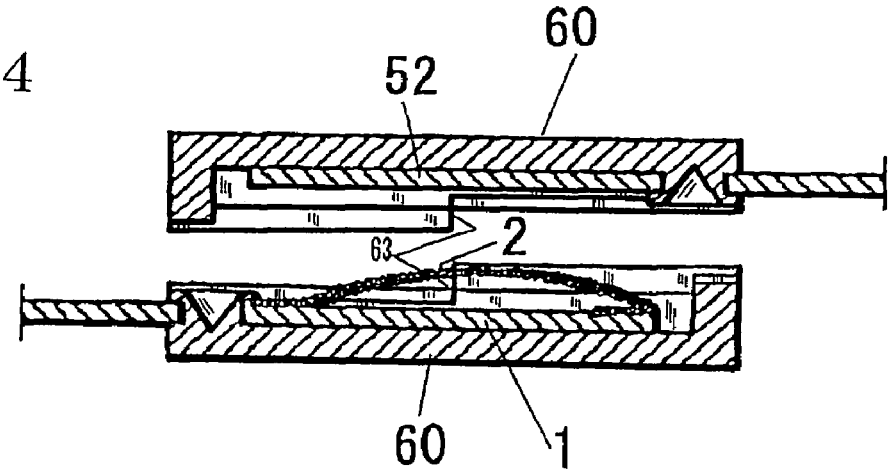
Fig.7—5
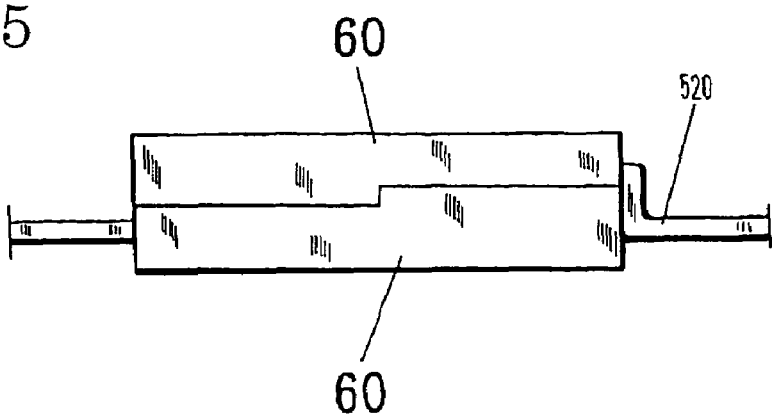

THERMOSENSOR, THERMOPROTECTOR, AND METHOD OF PRODUCING A THERMOSENSOR

BACKGROUND OF THE INVENTION

1. Field of the Invention

The present invention relates to a thermoprotector in which the melting point or the softening point of a fusible material is set as the operating temperature, a thermosensor which is useful in the thermoprotector, and a method of producing a thermosensor.

2. Explanation of Related Art

As a thermoprotector which senses abnormal heating of an electrical or electronic apparatus, and which performs a cut-off operation based on this sense to interrupt the apparatus from a power supply, thereby preventing overheat of the apparatus and occurrence of a fire, a system in which elastic distortion energy is stored and the elastic distortion energy is released by melting or softening of a fusible material is known.

For example, an elastic metal piece 2' is forcibly bent as shown in (10A) of FIG. 10, the both ends of the elastic metal piece 2' are bonded against a bending reaction force to a pair of stationary terminals 41', 42' by an fusible alloy (solder) 3' having a predetermined melting point. When the ambient temperature is raised to the melting point of the fusible alloy 3' and the fusible alloy is melted, bending stress of the elastic metal piece 2' is released to cancel the joining between one end of the elastic metal piece 2' and the one stationary terminal 42' as shown in (10B) of FIG. 10, thereby interrupting the power supply (see Japanese Patent Application Laying-Open No. 7-29481).

As shown in (11A) of FIG. 11, a device is known in which a pellet 2' having a predetermined melting point, a seat plate 15', a compression spring 1', and a seat plate 16' are sequentially housed in a metal case 14' to which a lead terminal 13' is attached at one end, with starting from the one end. Furthermore, a contact 42' in which the outer circumference is in sliding contact with the inner face of the metal case is housed in the case, a lead pin bushing 17' is fixed to the other end side of the metal case 14', and a trip spring 18' is incorporated between the bushing 17' and the contact 42', thereby constituting a conduction path passing the route of the lead terminal 13'→the metal case 14'→the contact 42'→a lead pin 41'. When the ambient temperature is raised to the melting point of the pellet 2' and the pellet 2' is melted, compression stress of the compression spring 1' is released, and the contact 42' is detached from the tip end of the lead pin 41' by compression stress of the trip spring 18' as shown in (11B) of FIG. 11, thereby interrupting the conduction path (see "ELECTRICAL ENGINEERING HANDBOOK" First Edition, The Institute of Electrical Engineers of Japan, Feb. 28, 1988, p. 818).

In the system shown in FIG. 10, however, the bending reaction force M' and an expanding force F' of the elastic metal piece act on the fusible alloy (solder). Therefore, the stress distribution in the fusible alloy is complicated, creep due to stress concentration is readily produced, and an operation failure easily occurs. Since the fusible alloy forms a part of a conduction path, the fusible alloy may generate heat because of an increase of the resistance due to creep of the fusible alloy, thereby causing a possibility that an operation error may be caused by self-heating. Furthermore, an operation error may be caused also by stringing of the molten alloy.

In the system shown in FIG. 11, the pellet can be uniformly compressed by pressure equalization of the seat plates, but the structure is complicated. Therefore, the system is inevitably disadvantageous in miniaturization and cost.

SUMMARY OF THE INVENTION

It is an object of the invention to ensure a long-term stability of a thermosensor of a type in which elastic distortion energy of an elastic member that holds the elastic distortion energy by joint fixation due to a soluble material such as solder is released by melting of the soluble material, thereby causing an operation, and improve the operation reliability of a thermoprotector using such a thermosensor.

The thermosensor of the invention is characterized in that both ends of an elastic member are fixed to a body in a state where the elastic member is compressed in a longitudinal direction, to form the elastic member into a convex curved shape, one end side of the convex curved shape is raised by a predetermined angle with respect to the body, a flexure angle of another end of the convex curved shape is zero, the fixation of one end portion of the elastic member and the body is conducted via a fusible material, and a melting point or a softening point of the fusible material is an operating temperature.

The thermosensor of the invention is characterized in that, in the thermosensor, one end portion of the elastic member is inward folded, and a folded piece is face joined to a surface of the body via the fusible material.

The thermosensor of the invention is characterized in that, in the thermosensor, one end portion of the elastic member is folded, and an inner side face of a folded piece is face joined to a rear face of a tip end portion of the body via the fusible material.

The thermosensor of the invention is characterized in that, in the thermosensor, the elastic member is a metal, a composite material of a metal and a resin, or a polymer.

The thermosensor of the invention is characterized in that, in the thermosensor, the fusible material is a low-melting point metal.

The thermosensor of the invention is characterized in that, in the thermosensor, the fusible material is a thermoplastic resin.

The thermosensor of the invention is characterized in that, in the thermosensor, the elastic member is a metal, and forms a part of a conduction path.

The thermoprotector of the invention is characterized in that the thermosensor is configured with setting as a body face a surface of one of paired electrodes which are disposed via a gap, an elastic metal of the thermosensor and the one electrode are electrically conducted with each other, and the elastic metal of the thermosensor and another one of the electrodes are in contact with other.

The thermoprotector of the invention is characterized in that the thermoprotector has a stationary electrode and a movable electrode, and the thermosensor is incorporated so that the movable electrode is contacted with the stationary electrode by an operation of the thermosensor.

The method of producing a thermosensor of the invention is a method of producing the thermosensor, and characterized in that one end portion of a wide elastic member material is face joined to a wide body material via a fusible material, the joined member is cut into many strips and the elastic member piece is folded back with setting the face joined portion as a boarder, or the elastic member material is folded back with setting the face joined portion as a boarder and the joined member is cut into many strips, and thereafter another end portion of the elastic member piece is fixed to a body at a flexure angle of zero in a state where the elastic member piece is compressed in a longitudinal direction.

The method of producing a thermosensor of the invention is a method of producing the thermosensor, and characterized in that one end portion of a wide elastic member material is face joined to a rear face of a tip end portion of a wide body material via a fusible material, the joined member is cut into many strips and the elastic member piece is folded back toward a surface of a body, or the elastic member material is folded back toward a surface of the body and the joined member is cut into many strips, and thereafter another end portion of the elastic member piece is fixed to the body at a flexure angle of zero in a state where the folded elastic member piece is compressed in a longitudinal direction.

The dynamic state of the elastic member can be approximated to that in the case where a column in which one end is fixed and the other end is hinge-supported is compressed in an axial direction. Application of a bending moment reaction force on the fixed portion of the one end of the elastic member which corresponds to a hinge-supported side can be sufficiently suppressed. Main stress acting on the face joining interface by the fusible material between the one end of the elastic member and the body can be restricted to shearing stress, so that application of a cleavage force due to the bending moment reaction force on the interface can be largely reduced.

Therefore, the face joining interface by the fusible material can be stably held, and an operation failure due to, for example, creep of the fusible material of the joining interface can be satisfactorily prevented from occurring.

In a battery pack of a lithium-ion secondary battery, a lithium polymer secondary battery, or the like, a thermoprotector which senses abnormal heat generation of the battery or a power transistor, and which interrupts the energization is necessary. The thermoprotector of the invention can be easily miniaturized, and can be satisfactorily incorporated in a battery pack. Consequently, the thermoprotector can be preferably used as a battery thermoprotector.

BRIEF DESCRIPTION OF THE DRAWINGS

FIG. 7-1 is a view showing an example of a housing piece used in the thermoprotector of the invention;

FIG. 7-2 is a view showing a part of steps of producing the thermoprotector with using the housing piece of FIG. 7-1;

FIG. 7-3 is a view showing another part of steps of producing the thermoprotector with using the housing piece of FIG. 7-1;

FIG. 7-4 is a view showing a further part of steps of producing the thermoprotector with using the housing piece of FIG. 7-1;

FIG. 7-5 is a view showing an embodiment of the thermoprotector in which the housing piece of FIG. 7-1 is used;

Figure 1A:
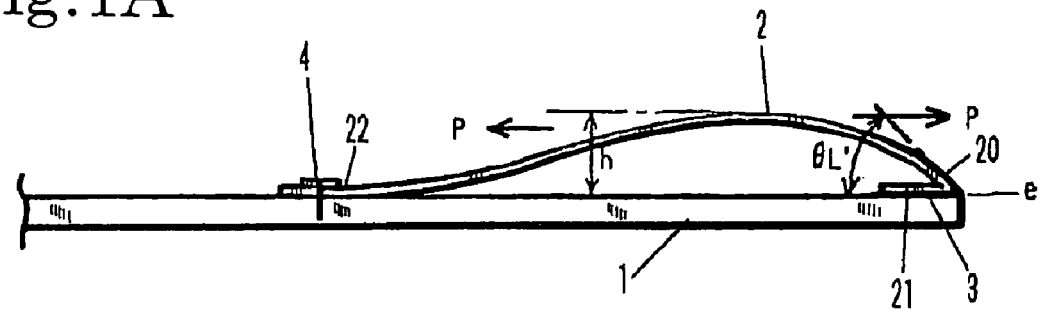
FIG. 1 is a view showing the thermosensor of the invention.
Figure 1B:
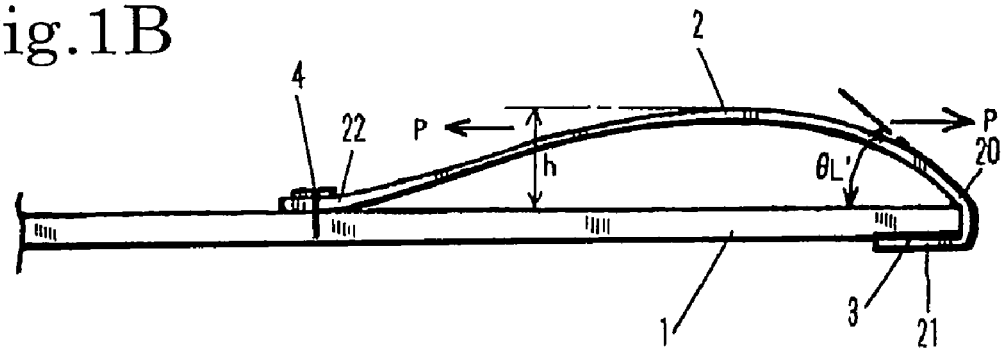

DESCRIPTION OF THE PREFERRED EMBODIMENTS (1A) and (1B) of FIG. 1 show different examples of the basic structure of the thermosensor of the invention.

Referring to (1A) and (1B) of FIG. 1, 1 denotes a body, 2 denotes an elastic member having a plate-like, foil-like, or linear shape, and 3 denoted a fusible material. In the example of (1A) of FIG. 1, one end portion 21 of the elastic member 2 is face joined to the surface of the body 1 by the fusible material 3, the elastic member 2 is folded back by a predetermined angle θL' with setting an end e of the face joined portion as a boarder, and another end portion 22 of the elastic member 2 is face joined to the body 1 at a flexure angle of zero by adequate means such as riveting, or welding 4 in a state where a longitudinal compression force p is applied to the elastic member 2.

In the example of (1B) of FIG. 1, the one end portion 21 of the elastic member 2 is face joined to the rear face of a tip end portion of the body 1 by the fusible material 3, the elastic member 2 is folded back toward the surface of the body 1 by a predetermined angle θL', and the other end portion 22 of the elastic member 2 is face joined to the body 1 at the flexure angle of zero by adequate means such as riveting, or welding 4 in a state where the longitudinal compression force p is applied to the elastic member 2.

In both the basic structures, the elastic member 2 is deformed into a convex curved shape, and elastic bending distortion energy is stored. When the fusible material 3 is melted or softened, the fixation by the face joint is canceled, the elastic bending distortion energy is released, and the height h of the convex curved shape is reduced. The reduction appears as a heat sensing signal, and the sensor operates. In both the basic structures, one end portion 20 of the elastic member 2 which is deformed into the convex curved shape is dynamically equivalent to a rigid joint of a predetermined angle.

Figure 2:
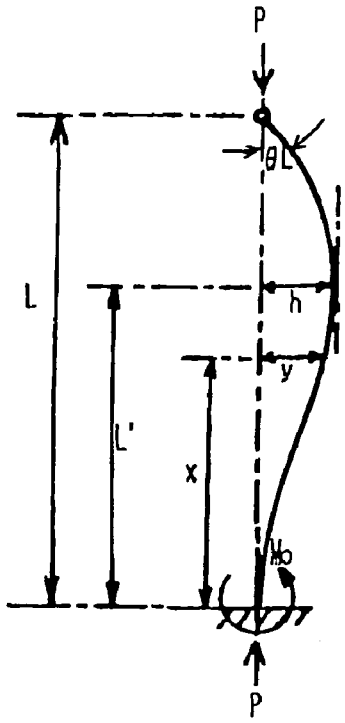
FIG. 2 is a view showing a dynamic state of a column in which one end is fixed and the other end is hinge-supported.

FIG. 2 shows a column in which one end is fixed and the other end is hinge-supported (Long column), and which is used for considering the dynamic state of the thermosensor of the invention.

Referring to FIG. 2, when a bending moment at point (x, y) is $M_x$, $$d^2y/dx^2=-M_x/EI$$

is held (EI is the flexural rigidity of the column), and the bending moment $M_x$ is given by $$M_x=py-M_ox/L.$$

When $p/EI=k^2$, therefore, the shape y of a convex curve is given by $$y=A[\cos kx-(\sin kx/kL)+(x/L)-1]\tan kL=kL.$$

Since the height h of the convex curve y is known at x=L', the coefficient A can be obtained from $$y_{x=L'}=h,\ (dy/dx)_{x=L'}=0.$$

Therefore, the flexure angle θL at the hinge-supported end is given by $$\theta L=(dy/dx)_{x=L}=A[(\cos kL/L)-k(\sin kL)+(1/L)].$$

Referring to FIG. 2, even if the hinge-supported end is dynamically frozen (replaced with a rigid joint of the same angle as the flexure angle of the hinge-supported end), the dynamic state is unchanged. A column indicated by the solid line 3A in FIG. 3 will be considered. In the column, one end is a rigid joint n of an angle θL, the other end has a flexure angle of zero, and a longitudinal compression force is p. The bending moment reaction force in the one end or the rigid joint (hereinafter, referred to as one end rigid joint) n is zero.

Figure 3:
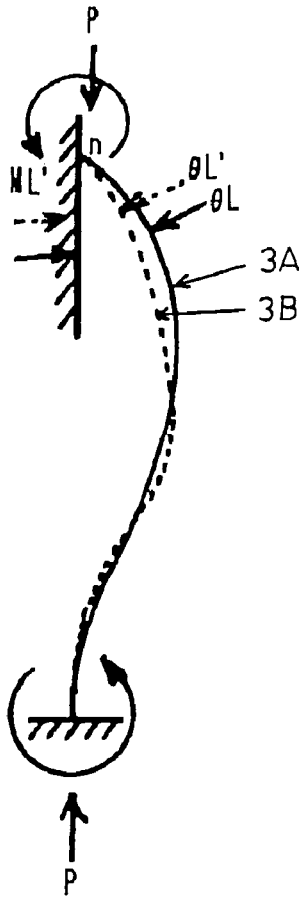
FIG. 3 is a view showing a dynamic state of the thermosensor of the invention.
Figure 4A:
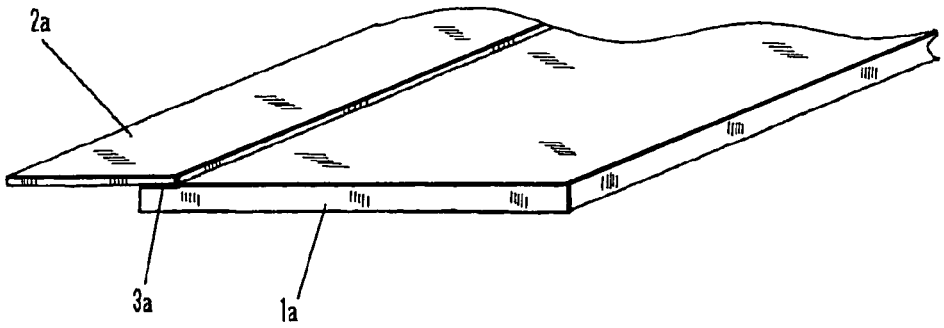
FIG. 4 is a view showing a method of producing an elastic member-provided body used in the thermosensor of the invention.
Figure 4B:
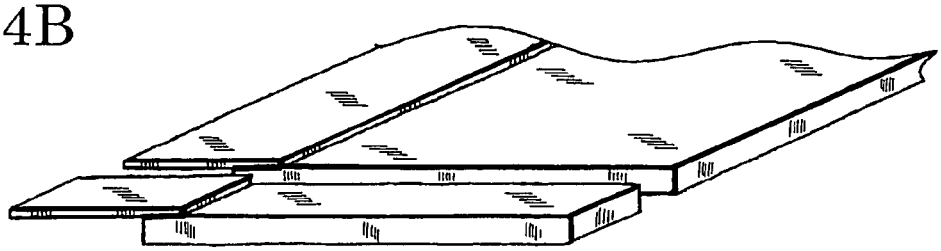
Figure 4C:
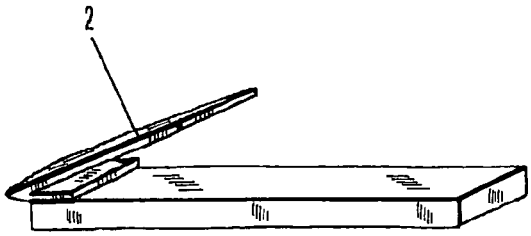
Figure 4D:
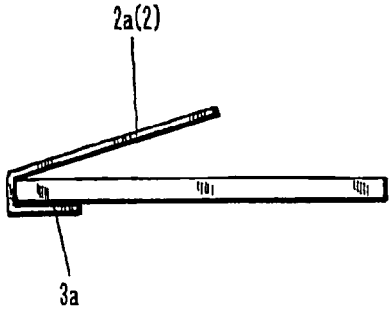

A column indicated by the broke line 3B in FIG. 3 in which a one end rigid joint has an angle of θL' and the other end has a flexure angle of zero will be considered. The bending moment reaction force ML' acting on the one end rigid joint is coincident with a bending moment necessary for distorting the angle θL of the one end rigid joint in the state of the solid line 3A where the bending moment reaction force acting on the one end rigid joint n is zero, to the angle θL'. As the difference between θL and θL' is smaller, the bending moment reaction force ML' acting on the one end rigid joint of the broke line 3B is made smaller.

In the thermosensor of the invention, as shown in FIG. 1, the both ends of the elastic member 2 are fixed under the predetermined longitudinal compression force p so that the angle of the rigid joint 20 which is of the one end rigid joint fixation is the predetermined angle θL', and the flexure angle of the other end 22 is zero. The angle θL' of the rigid joint can be set so as to approach the angle θL at which the bending moment reaction force is zero. Therefore, the bending moment reaction force in the fixing portion of the one end 21 of the elastic member via the fusible material 3 can be reduced, and the reaction force acting on the joining interface of the fusible material 3 can be restricted to the reaction force against the longitudinal compression force p, i.e., stress mainly consisting of shearing stress. Stress which is based on the bending moment reaction force, and which is to cleave the joining interface can be satisfactorily prevented from acting.

When the longitudinal compression force acting on the elastic member is indicated by p and the area of the joining interface is indicated by S, shearing stress τ of the joining interface is given by τ=p/S. The shearing strength of the joining interface must exceed f/S. The shearing strength must be provided with a sufficient safety factor. Therefore, preferably, a hole, a recess, or a notch is formed in one or both of the other end portion of the elastic member and the body face which are to be face joined to each other, and the fusible material is caused to enter the hole or the like, or one or both of the other end portion of the elastic member and the body face which are face joined to each other are roughened, whereby the shearing strength of the joining interface is enhanced. Alternatively, in order to mechanically reinforce the interface which is face joined by the fusible material, the fusible material may be applied to the tip end face of the elastic member and the body face.

As the body 1, a material which can endure the longitudinal compression force p is used.

As the elastic member 2, a metal, a synthetic resin, or a composite material of a metal and a synthetic resin may be used. Such a composite material may include a resin to which metal powder is mixed. When a material having a high electrical resistance such as a resin to which metal powder is mixed is used as the elastic member, the sensor or the protector can be operated by causing the fusible material to be melted by heat generation due to energization of a resistor.

As the fusible material 3, a fusible alloy such as solder, a single metal, a thermoplastic resin, or a conductive thermoplastic resin to which conductive powder is added may be used.

One face or both faces of the whole length of the elastic member may be coated with the fusible material to uniformalize the flexural rigidity of the whole length of the elastic member. This is effective for preventing concentration of bending stress.

As the body, a base of a housing of a thermoprotector may be used as described later. Usually, an electrode having a lead portion is used as the body, and one end portion of the elastic member is face joined to a tip end portion of the electrode via the fusible material.

A set member of the electrode and the elastic member can be obtained in the following manner. As shown in (4A) of FIG. 4, one end portion of a wide elastic member material 2*a* is face joined via a fusible material 3*a* to the surface of a tip end portion of a wide electrode material 1*a* by a heat roller, electromagnetic induction heating, or the like. As shown in (4B) of FIG. 4, the joined member is cut by a die cutter into many rectangular strips. As shown in (4C) of FIG. 4, next, the elastic member 2 of the strip piece is folded back at a predetermined angle.

A wide electrode material and a wide elastic member material may be face joined to each other, the elastic member material may be folded back at a predetermined angle, and the joined member may be then cut into many rectangular strips.

As shown in (4D) of FIG. 4, the folding of the elastic member piece 2 or the wide elastic member material 2*a* may be conducted while moving the piece or the material to the side face of the body opposite to the joining face 3*a*.

After the set member of the electrode and the elastic member is produced, the other end portion 22 of the elastic member 2 is fixed by face joining to the body face at a flexure angle of zero. In the fixation, useful is riveting in which a previously disposed projection of a synthetic resin (having a softening point which is higher than the softening point of the fusible material) is used as a fixing part, an adhesive agent having a melting or softening point which is higher than the melting or softening point of the fusible material, or welding (preferably, welding in which a flux is used) such as resistance welding, or electromagnetic induction heating welding.

As described above, the thermosensor of the invention is dynamically equivalent to a column in which one end is fixed and the other end is hinge-supported. When the height of the convex curve is h and the length of the elastic member is L, the stored elastic bending distortion energy is an intermediate value between the elastic bending distortion energy $2h^2\pi^4/L^3$ of a column in which both ends are fixed, and the elastic bending distortion energy $h^2\pi^4/(2L^3)$ of a column in which both ends are hinge-supported. As compared with a thermosensor in which both ends of the elastic member are fixed at a flexure angle of zero, the length of the elastic member can be shortened under the conditions of the same stored elastic bending distortion energy. This is advantageous in miniaturization of a thermosensor.

When the height h of the convex curve is identical, the total length of the convex curve in a column in which one end is fixed and the other end is hinge-supported is longer (about 1.2 times) than that in a column in which both ends are fixed. Under the conditions of the same total length of the convex curve, therefore, the distance between the supports in the column is shortened. In the thermosensor of the invention, the length can be correspondingly shortened.

Figure 5A:
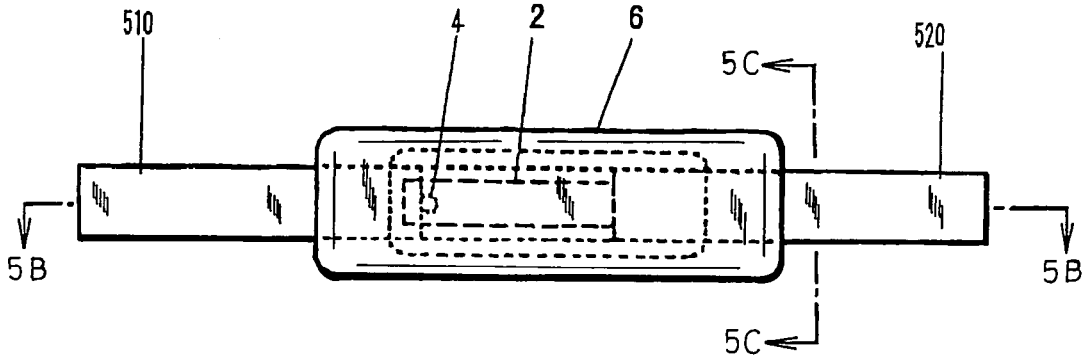
FIG. 5 is a view showing an embodiment of the thermoprotector of the invention.
Figure 5B:
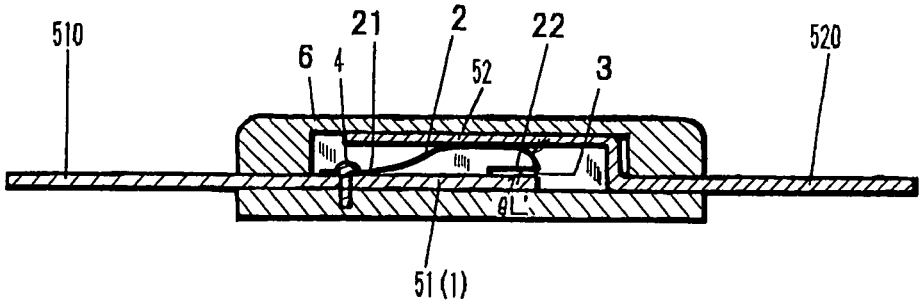
Figure 5C:
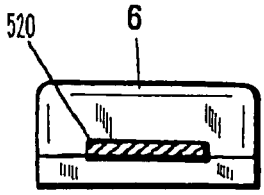

(5A) of FIG. 5 is a plan view of an embodiment of the thermoprotector of the invention, (5B) of FIG. 5 is a section view taken along the line 5B-5B in (5A) of FIG. 5, and (5C) of FIG. 5 is a section view taken along the line 5C-5C in (5A) of FIG. 5.

Referring to FIG. 5, 51 and 52 denote a pair of electrodes which are placed via a gap, and 510 and 520 denote lead portions of the electrodes. The electrode 51 is used also as the body. The reference numeral 2 denotes an elastic metal plate in which one end portion 21 is folded back so as to form a rigid joint of the above-mentioned angle θL', and face joined and fixed to a tip end portion of the electrodes 51 via the fusible material 3. In this state, the longitudinal compression force p is applied to the elastic plate 2 to give bending distortion energy to the elastic plate 2, and another end portion 22 of the elastic plate 2 is face contacted and fixed to the electrodes 51 at a flexure angle of zero by riveting 4 or the like. The arrangement is surrounded by a housing 6, and the outer face of the convex curve of the elastic plate 2 is in contact with the other electrode 52.

As the housing 6, an insulator such as ceramics or a synthetic resin is used. The housing may be configured by upper and lower two split pieces, and assembled by, for example, fusion bonding such as high-frequency welding, an adhesive agent, or fitting.

In the thermoprotector, normally, the electrical conduction is made through a path of the lead portion of the one electrode→the elastic plate→the contact face of the elastic plate and the other electrode→the lead portion of the other electrode. Since the fusible material 3 is not included in the conduction path, the conductivity of the fusible material does not participate in that of the conduction path. As the fusible material, also a thermoplastic resin may be used.

Figure 6:
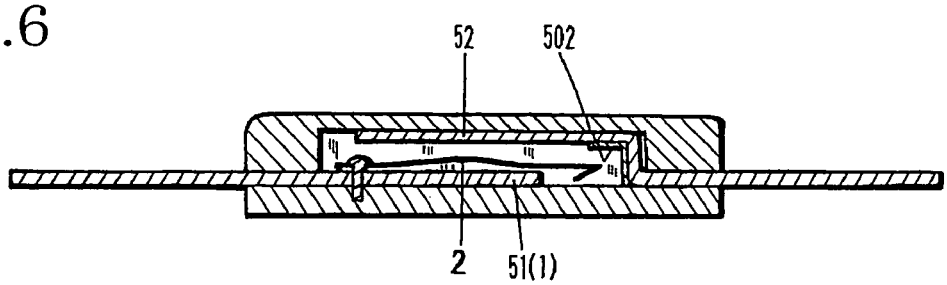
FIG. 6 is a view showing a state of the thermoprotector shown in FIG. 5 after operation.

The operation of the thermoprotector will be described. When the external temperature is raised and the fusible material 3 is heated to the melting point or the softening point, the face joint by the fusible material 3 between the one end portion 21 of the elastic plate and the one electrode 51 is released by the bending distortion energy of the elastic plate 2. As shown in FIG. 6, the elastic plate 2 is then restored to the original flat plate-like shape to make the bending height of the elastic plate zero. As a result, the contact between the elastic plate 2 and the other electrode 52 is cancelled, and a non-return conduction cut-off operation is completed. In this case, the requirement for starting the operation is that the fusible material is melted or softened and the elastic distortion energy of the elastic member is released. Even when string of the fusible material occurs, therefore, the operation performance is not affected.

In order to assure reliable insulation between the folded portion of the tip end of the elastic member and the other electrode, it is preferable to dispose an insulating film 502 on the other electrode 52 as shown in FIG. 6.

A contact pressure is applied to the contact face between the outer face of the convex curve of the elastic plate 2 and the other electrode 52 in (5B) of FIG. 5, and the contact resistance is reduced. In order to further reduce the contact resistance, the contact face may be bonded by solder which is lower in melting point than the fusible material. In this case, in order to suppress string, the layer of the low-melting point solder is preferably made sufficiently thin.

In the thermoprotector of the invention, it is preferable to commonly configure the upper and lower housing pieces. FIGS. 7-1 to 7-5 show such embodiments.

FIG. 7-1 [(7-1A) of FIG. 7-1 is a plan view, (7-1B) is a section view taken along the line 71B-71B of (7-1A) of FIG. 7-1, (7-1C) is a left side view, and (7-1D) is a right side view] shows an example of a housing piece 60 in which side wall portions 62, 62 are disposed on the both sides of a base portion 61, steps 63 are formed in the middles of the side wall portions in the longitudinal direction, and a triangular ridge 64 serving as an energy director for ultrasonic welding is disposed on the inner half face of the upper face of each of the side walls. A riveting projection 4 in which the width is narrower than the inner width of the housing piece is disposed in one side of the base portion. Auxiliary walls 65 which are slightly higher than the upper faces of the side walls 62 are disposed in the other end side of the base portion 61 so as to be integrated with the side walls 62, respectively.

When the width of the auxiliary wall 65 is a, the width of the riveting projection 4 is b, the inner width of the housing piece is c, (2b+a) is slightly smaller than c. A gap (c−a−2b) which is produced as a result of this dimensional relationship is small, and can be closed by deformation of the resin of the housing in heating joint by ultrasonic welding of housing pieces which will be described later.

The thermoprotector of the invention is produced with using such housing pieces in the following manner. First, a hole is opened in the elastic member-provided electrode which is obtained as shown in FIG. 4. As shown in FIG. 7-2 [(7-2A) of FIG. 7-2 is a plan view, (7-2B) is a section view taken along the line 72B-72B of (7-2A) of FIG. 7-2, and (7-2C) is a section view taken along the line 72C-72C of (7-2B) of FIG. 7-2], the electrode 51 which is provided with the elastic member 2, and in which the hole is opened is fixed to the one housing piece 60 by heat crushing the riveting projection 4. As shown in FIG. 7-3, also in the electrode 52 not provided with an elastic member, a hole is opened, and the electrode is fixed to the other housing piece 60 in the hole by heat crushing the riveting projection 4. As shown in FIG. 7-4, thereafter, the two housing pieces are vertically superimposed on each other so that their electrode lead portions are oppositely directed, and the side walls of the housing pieces 60, 60 are fitted with each other by engagement of the steps 63, 63. Then, the fitted housing pieces are set in an ultrasonic welder, and the energy directors of the housing pieces are crushed and welded, thereby completing the production of the thermoprotector.

In order to make the levels of the lead portions coincident with each other, the one lead portion 520 may be bent via a step along the end face of the housing as shown in FIG. 7-5. The state after the thermoprotector shown in FIGS. 7-1 to 7-2 operates is substantially identical with that shown in FIG. 6. The thermoprotector has a feature that the tip end portion of the elastic member 2 which is released by melting or softening of the fusible material enters a space immediately below the riveting projection of the housing piece 60 on the side of the electrode 52, thereby surely preventing reconduction with the electrode 52 from occurring.

Figure 8A:
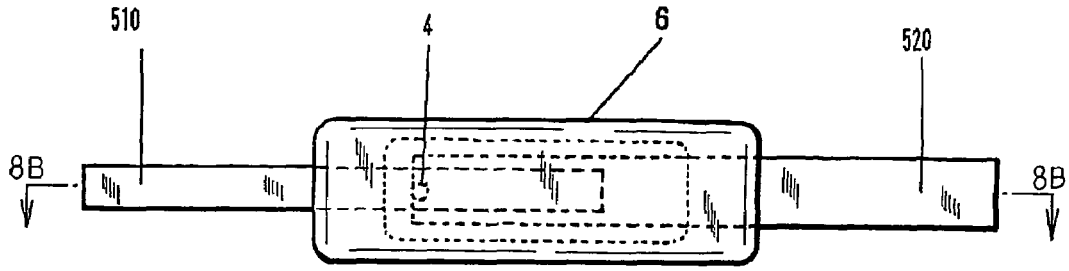
FIG. 8 is a view showing another embodiment of the thermoprotector of the invention.
Figure 8B:
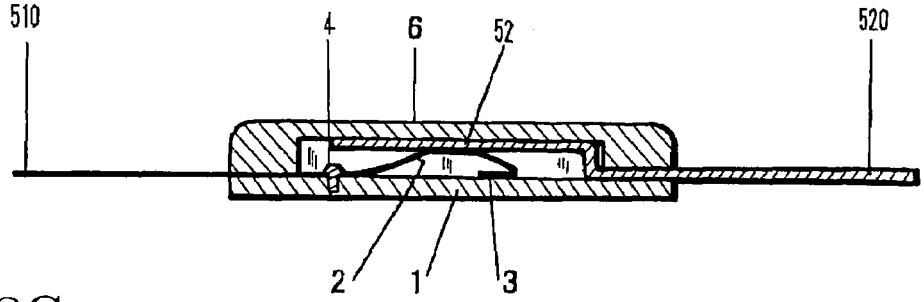
Figure 8C:
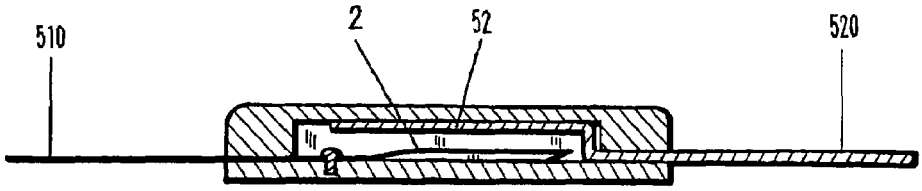

(8A) of FIG. 8 is a plan view of another embodiment of the thermoprotector of the invention, and (8B) of FIG. 8 is a section view taken along the line 8B-8B in (8A) of FIG. 8. One lead conductor is made of an elastic metal, and a tip end portion of the lead wire is used as the elastic member of the thermosensor.

(8C) of FIG. 8 is a view showing a state of the embodiment after operation.

Referring to FIG. 8, 1 denotes a base body of a housing which is configured by an insulator such as ceramics or a synthetic resin, and 510 denotes one lead conductor. A tip end portion 2 of the lead conductor is formed by a plate-like elastic metal. The front end of the tip end portion 2 is inward folded so as to constitute a rigid joint of the above-mentioned angle θL' with respect to the base body 1, and the folded piece is face joined via the fusible material 3 such as a thermoplastic resin. In this state, the longitudinal compression force p is applied to the tip end portion 2 to give bending distortion energy thereto, and a rear side portion of the tip end portion 2 is face contacted and fixed to the body face by riveting, welding 4, or the like, thereby constituting the thermosensor of the invention.

In the case where a fusible metal is used in the joint fixation of the tip end portion 2 of the elastic lead conductor to the body face under the face contact, the fixation may be conducted after the body face is metallized by applying and etching of metal foil, or printing and baking of metal powder paste.

The reference numeral 520 denotes another flat lead conductor in which a tip end portion 52 is bent and shaped to be in contact with the bent top face of tip end portion 2 of the one elastic lead conductor.

The reference numeral 6 denotes a housing which is configured by an insulator such as ceramics or a synthetic resin, and bonded to the base body by, for example, fusion bonding such as high-frequency welding (in the case where both the base and the housing are made of a synthetic resin), an adhesive agent, or fitting.

As the one lead conductor, an elastic round wire in which a tip end portion is crushed to be thinned may be used.

In the thermoprotector, normally, the electrical conduction is made through a path of the one lead conductor 510→the contact face between the convex curved portion of the tip end portion 2 of the lead conductor and the tip end portion 52 of the other lead conductor 520→the other lead conductor 520. Since the fusible material 3 is not included in the conduction path, the conductivity of the fusible material does not participate in that of the conduction path.

The operation of the thermoprotector will be described. When the external temperature is raised and the fusible material 3 is heated to the melting point or the softening point, the face joint by the fusible material 3 between the tip end portion 2 of the one lead conductor and the body face is released by the bending distortion energy of the tip end portion 2 of the one elastic lead conductor. As shown in (8C) of FIG. 8, the tip end portion 2 of the elastic lead conductor is then restored to the original flat plate-like shape to make the bending height of the tip end portion 2 zero. As a result, the contact face between the tip end portion 2 of the one elastic lead conductor and the tip end portion 52 of the other lead conductor 520 is cancelled, and a non-return conduction cut-off operation is completed.

Also in the case described above, a contact pressure is applied to the contact face between the outer bent face of the tip end portion 2 of the elastic lead conductor and the tip end portion 52 of the other lead conductor 520, and the contact resistance is reduced. In order to further reduce the contact resistance, the contact face may be bonded by solder which is lower in melting point than the fusible material.

Figure 9A:
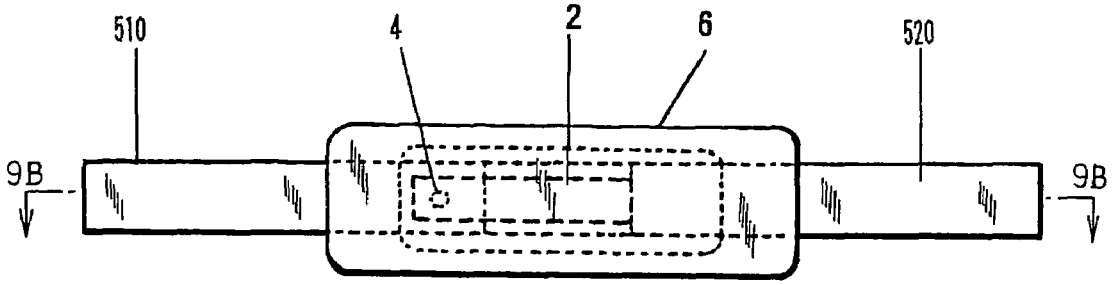
FIG. 9 is a view showing a further embodiment of the thermoprotector of the invention.
Figure 9B:
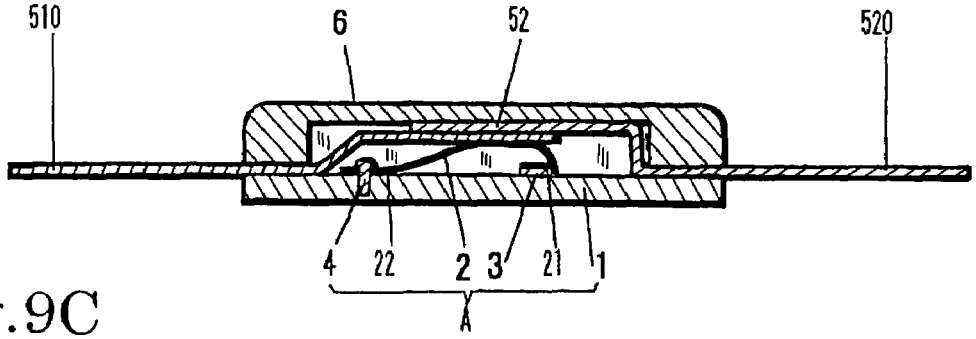
Figure 9C:
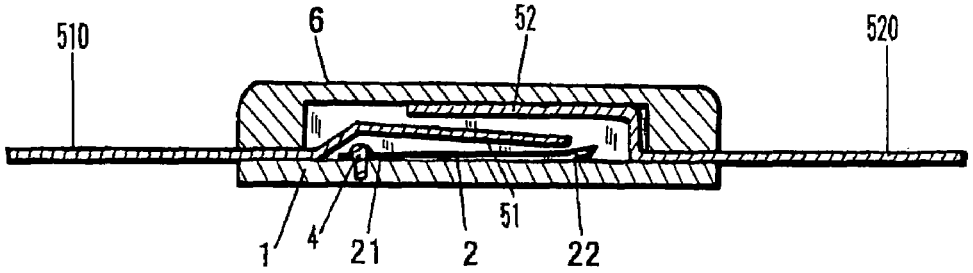
Figure 10A:
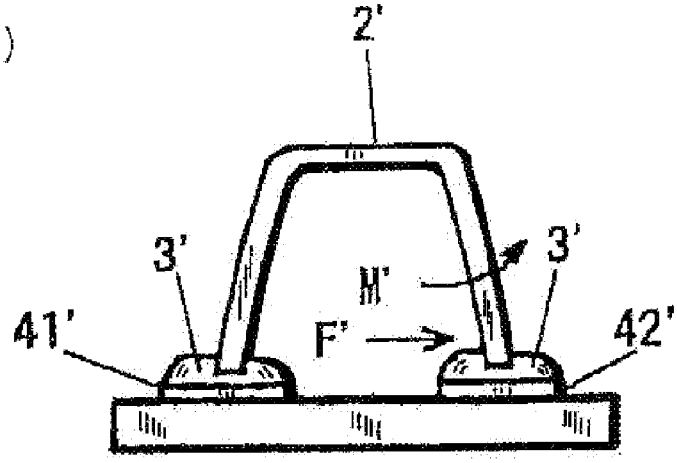
Fig.10A (PRIOR ART)
FIG. 10 is a view showing a conventional thermoprotector.
Figure 10B:
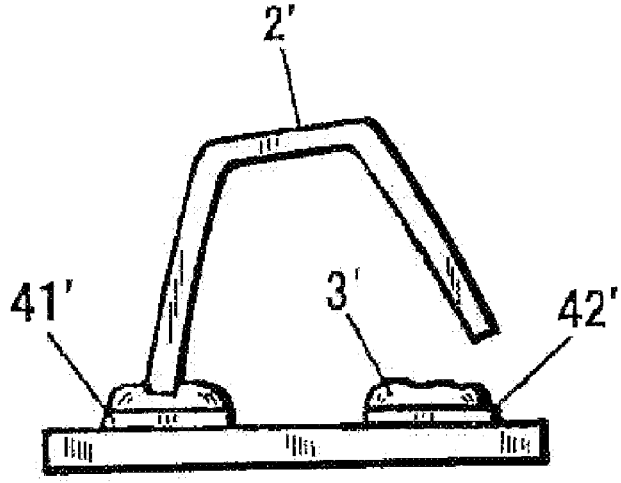
Fig.10B (PRIOR ART)
Figure 11A:
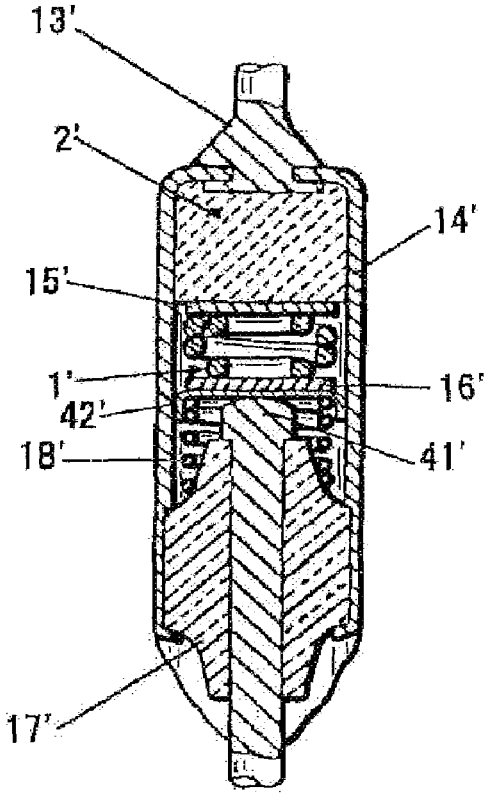
Fig.11A (PRIOR ART)
FIG. 11 is a view showing another example of a conventional thermoprotector.
Figure 11B:
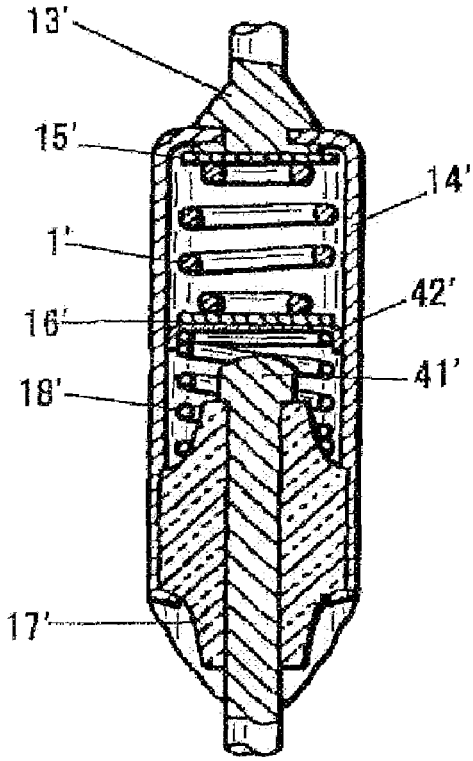
Fig.11B (PRIOR ART)

(9A) of FIG. 9 is a plan view of a further embodiment of the thermoprotector of the invention, and (9B) of FIG. 9 is a section view taken along the line 9B-9B in (9A) of FIG. 9. The embodiment has a stationary electrode and a movable electrode, and the thermosensor of the invention is incorporated. (9C) of FIG. 9 is a view showing a state of the embodiment after operation.

Referring to FIG. 9, 1 denotes a base body of a housing which is configured by an insulator such as ceramics or a synthetic resin, 51 denotes the movable electrode, 510 denotes a lead portion which is formed integrally with the movable electrode 51, 52 denotes the stationary electrode, 520 denotes a lead portion which is formed integrally with the stationary electrode 52, and A denotes a thermosensor. In the thermosensor, one end portion 21 of the elastic plate 2 made of a metal or a synthetic resin is inward folded at a predetermined angle. The folded piece 21 is face contacted, and joined and fixed to the body face by melting and solidification of the fusible material 3 such as a fusible alloy or a thermoplastic resin to form a rigid joint of the above-mentioned angle (θL'). In this state, in the same manner as described above, the longitudinal compression force (p) is applied to the elastic plate 2 to give bending distortion energy to the elastic plate 2, and another end portion 22 of the elastic plate 2 is face contacted and fixed to the body face by riveting, welding 4, or the like.

The welding and fixation of the elastic plate 2 to the body face under the face contact, and the joining and fixation by the fusible material 3 under the face contact may be conducted after the body face is metallized by applying and etching of metal foil, or printing and baking of metal powder paste.

The reference numeral 6 denotes a housing which is configured by an insulator such as ceramics or a synthetic resin, and bonded to the base body 1 by, for example, fusion bonding such as high-frequency welding (in the case where both the base and the housing are made of a synthetic resin), an adhesive agent, or fitting.

In the thermoprotector, normally, the electrical conduction is made through a path of the one lead conductor→the stationary electrode→the contact face between the stationary electrode and the movable electrode→the movable electrode→the other lead conductor. Since the fusible material 3 is not included in the conduction path, the conductivity of the fusible material does not participate in that of the conduction path.

The operation of the thermoprotector will be described. When the external temperature is raised and the fusible material 3 is heated to the melting point or the softening point, the face joint by the fusible material 3 between the elastic plate 2 and the body face is released by the bending distortion energy of the elastic plate 2 of the thermosensor A. As shown in (9C) of FIG. 9, the elastic plate 2 is then restored to the original flat plate-like shape to make the bending height of the elastic plate 2 of the thermosensor A zero. As a result, the movable electrode 51 is moved by its elasticity together with the elastic plate 2 of the thermosensor A, and separated from the stationary electrode 52, whereby a non-return conduction cut-off operation is completed.

As the elastic metal material, for example, phosphor bronze can be used. In the case where a resin product is used as the elastic material, FRP in which a resin (a thermoplastic resin or a thermosetting resin) is reinforced by fibers such as glass fibers, metal fibers, or synthetic fibers, high-rigidity engineering plastic, or the like can be selected in consideration of relative relationships with the melting point of a thermoplastic resin used as the fusible material. As the elastic material, a composite material of an elastic metal material and a synthetic resin, such as a laminated member of a phosphor bronze plate and a polyamide film may be used.

For example, the dimensions of the elastic member are set in the following manner. In the case of a metal elastic plate, the thickness is 0.008 to 0.1 mm, the width is 0.3 to 4.6 mm, and the length is 1.5 to 11 mm.

As a resin used as the elastic material, and a thermoplastic resin as the fusible material, resins of a predetermined melting point can be selected from: engineering plastics such as polyethylene terephthalate, polyethylene naphthalate, polyamide, polyimide, polybutylene terephthalate, polyphenylene oxide, polyethylene sulfide, and polysulfone; engineering plastics such as polyacetal, polycarbonate, polyphenylene sulfide, polyoxybenzoyl, polyether ether ketone, and polyetherimide; polypropylene; polyvinyl chloride; polyvinyl acetate; polymethyl methacrylate; polyvinylidene chloride; polytetrafluoroethylene; ethylene-polytetrafluoroethylene copolymer; ethylene-vinyl acetate copolymer (EVA); AS resin; ABS resin; ionomer; AAS resin; ACS resin; etc.

As the housing, in place of these resins, also ceramics may be used. The dimensions of the housing are set, for example, so that the thickness is 0.3 to 1.5 mm, the width is 1 to 5 mm, and the length is 2 to 12 mm.

As a fusible alloy used as the fusible material, it is preferable to use an alloy which does not contain an element harmful to the biological system, such as Pb or Cd. A composition which can realize a melting point suitable to the operating temperature of the thermoprotector can be selected, for example, from: [A] compositions of In—Sn—Bi alloys such as (1) 43%<Sn≦70%, 0.5%≦In≦10%, and the balance Bi, (2) 25%≦Sn≦40%, 50%≦In≦55%, and the balance Bi, (3) 25%<Sn≦44%, 55%<In≦74%, and 1%≦Bi<20%, (4) 46%<Sn≦70%, 18%≦In<48%, and 1%≦Bi≦12%, (5) 5%≦Sn≦28%, 15%≦In<37%, and the balance Bi (excluding a range of Bi±2%, In and Sn±1% with respect to Bi 57.5%, In 25.2%, and Sn 17.3%, and Bi 54%, In 29.7%, and Sn 16.3%), (6) 10%≦Sn≦18%, 37%≦In≦43%, and the balance Bi, (7) 25%<Sn≦60%, 20%≦In<50%, and 12%<Bi≦33%, (8) a composition in which 0.01 to 7 weight parts of a total of one or two or more of Ag, Au, Cu, Ni, Pd, Pt, Sb, Ga, Ge, and P are added to 100 weight parts of any one of (1) to (7), (9) 33%≦Sn≦43%, 0.5%≦In≦10%, and the balance Bi, (10) a composition in which 3 to 5 weight parts of Bi are added to 100 weight parts of 47%≦Sn≦49% and 51%≦In≦53%, (11) 40%≦Sn≦46%, 7%≦Bi≦12%, and the balance In, (12) 0.3%≦Sn≦1.5%, 51%≦In≦54%, and the balance Bi, (13) 2.5%≦Sn≦10%, 25%≦Bi≦35%, and the balance In, (14) a composition in which 0.01 to 7 weight parts of a total of one or two or more of Ag, Au, Cu, Ni, Pd, Pt, Sb, Ga, Ge, and P are added to 100 weight parts of any one of (9) to (13), and (15) a composition in which 0.01 to 7 weight parts of a total of one or two or more of Ag, Au, Cu, Ni, Pd, Pt, Sb, Ga, Ge, and P are added to 100 weight parts of 10%≦Sn≦25%, 48%≦In≦60%, the balance Bi; [B] compositions of Bi—Sn—Sb alloys such as (16) 30%≦Sn≦70%, 0.3%≦Sb≦20%, the balance Bi, and (17) a composition in which 0.01 to 7 weight parts of a total of one or two or more of Ag, Au, Cu, Ni, Pd, Pt, Ga, Ge, and P are added to 100 weight parts of (16); [C] compositions of added to 100 weight parts of (16); [C] compositions of In—Sn alloys such as (18) 52%≦In≦85% and the balance Sn, and (19) a composition in which 0.01 to 7 weight parts of a total of one or two or more of Ag, Au, Cu, Ni, Pd, Pt, Sb, Ga, Ge, and P are added to 100 weight parts of (18); [D] compositions of In—Bi alloys such as (20) 45%≦Bi≦55% and the balance In, and (21) a composition in which 0.01 to 7 weight parts of a total of one or two or more of Ag, Au, Cu, Ni, Pd, Pt, Sb, Ga, Ge, and P are added to 100 weight parts of (20); [E] compositions of Bi—Sn alloys such as (22) 50%<Bi≦56% and the balance Sn, and (23) a composition in which 0.01 to 7 weight parts of a total of one or two or more of Ag, Au, Cu, Ni, Pd, Pt, Ga, Ge, and P are added to 100 weight parts of (22); [F] In alloys such as (24) a composition in which 0.01 to 7 weight parts of a total of one or two or more of Au, Bi, Cu, Ni, Pd, Pt, Ga, Ge, and P are added to 100 weight parts of In, (25) a composition in which 0.01 to 7 weight parts of a total of one or two or more of Au, Bi, Cu, Ni, Pd, Pt, Ga, Ge, and P are added to 100 weight parts of 90%≦In≦99.9% and 0.1%≦Ag≦10%, and (26) a composition in which 0.01 to 7 weight parts of a total of one or two or more of Au, Bi, Cu, Ni, Pd, Pt, Ga, Ge, and P are added to 100 weight parts of 95%≦In≦99.9% and 0.1%≦Sb≦5%; and (27) a composition in which 0.01 to 7 weight parts of a total of one or two or more of Au, In, Cu, Ni, Pd, Pt, Ga, Ge, and P more of Au, In, Cu, Ni, Pd, Pt, Ga, Ge, and P are added to 100 weight parts of 2%≦Zn≦15%, 70%≦Sn≦95%, the balance Bi, and the alloy.

When the fusible alloy contains a large amount of a metal having a crystal structure of b.c.c., c.p.h., or the like, plastic deformation is suppressed, and the creep strength can be improved.

Preferably, these alloys, particularly, Bi-rich alloys previously cover laminarly the metal elastic member.

As the electrodes and the lead conductors, a conductive metal or a conductive alloy such as nickel, copper or a copper alloy can be used, and plating may be applied as required.

As described above, an electrode can be disposed in a tip end portion of a lead conductor, and a tip end portion of an elastic metal lead conductor can be crushed to be formed into an elastic plate-like shape.

In these cases, the body, and the lead conductor outside the housing can have an arbitrary shape.

A joined portion of an electrode or a lead conductor, an elastic member, or both fusible metals may be locally replaced with a material having an excellent weldability.

The electrode with a lead portion, and the lead conductor have, for example, a thickness of 0.05 to 0.3 mm, and a width of 0.5 to 4.6 mm.

What is claimed is:

1. A thermosensor comprising: an elastic member which is fixed to a body, both ends of said elastic member being fixed to said body in a state where said elastic member is compressed in a longitudinal direction, to form said elastic member into a convex curved shape, one end side of the convex curved shape being raised by a predetermined angle with respect to said body, a flexure angle of an other end of the convex curved shape being zero; and a fusible material which fixes one end portion of said elastic member and said body together, a melting point or a softening point of said fusible material being an operating temperature;

wherein one end portion of said elastic member is inward folded, and a folded piece is face joined to a surface of said body via said fusible material.

2. A thermosensor according to claim 1, wherein said elastic member is a metal, a composite material of a metal and a resin, or a polymer.

3. A thermoprotector wherein said thermoprotector has a stationary electrode and a movable electrode, and a thermosensor according to claim 2 is incorporated so that said movable electrode is contacted with said stationary electrode by an operation of said thermosensor.

4. A thermosensor according to claim 2, wherein said elastic member is a metal, and forms a part of a conduction path.

5. A thermoprotector comprising a thermosensor according to claim 4, wherein two paired electrodes are disposed with a gap in between, said elastic metal is disposed in said gap electrically connecting said paired electrodes by contacting each of said paired electrodes and one of said paired electrodes is said body.

6. A thermosensor according to claim 2, wherein said fusible material is a thermoplastic resin.

7. A thermoprotector wherein said thermoprotector has a stationary electrode and a movable electrode, and a thermosensor according to claim 6 is incorporated so that said movable electrode is contacted with said stationary electrode by an operation of said thermosensor.

8. A thermosensor according to claim 6, wherein said elastic member is a metal, and forms a part of a conduction path.

9. A thermoprotector comprising a thermosensor according to claim 8, wherein paired electrodes are disposed with a gap in between, said elastic metal is disposed in said gap electrically connecting said paired electrodes by contacting each of said paired electrodes and one of said paired electrodes is said body.

10. A thermosensor according to claim 2, wherein said fusible material is a low-melting point metal.

11. A thermoprotector wherein said thermoprotector has a stationary electrode and a movable electrode, and a thermosensor according to claim 10 is incorporated so that said movable electrode is contacted with said stationary electrode by an operation of said thermosensor.

12. A thermosensor according to claim 10, wherein said elastic member is a metal, and forms a part of a conduction path.

13. A thermoprotector comprising a thermosensor according to claim 12, wherein paired electrodes are disposed with a gap in between, said elastic metal is disposed in said gap electrically connecting said paired electrodes by contacting each of said paired electrodes.

14. A thermosensor according to claim 1, wherein said fusible material is a low-melting point metal.

15. A thermoprotector wherein said thermoprotector has a stationary electrode and a movable electrode, and a thermosensor according to claim 14 is incorporated so that said movable electrode is contacted with said stationary electrode by an operation of said thermosensor.

16. A thermosensor according to claim 14, wherein said elastic member is a metal, and forms a part of a conduction path.

17. A thermoprotector comprising a thermosensor according to claim 16, wherein paired electrodes are disposed with a gap in between, said elastic metal is disposed in said gap electrically connecting said paired electrodes by contacting each of said paired electrodes and one of said paired electrodes is said body.

18. A thermosensor according to claim 1, wherein said fusible material is a thermoplastic resin.

19. A thermoprotector wherein said thermoprotector has a stationary electrode and a movable electrode, and a thermosensor according to claim 18 is incorporated so that said movable electrode is contacted with said stationary electrode by an operation of said thermosensor.

20. A thermosensor according to claim 18, wherein said elastic member is a metal, and forms a part of a conduction path.

21. A thermoprotector comprising a thermosensor according to claim 20, wherein paired electrodes are disposed with a gap in between, said elastic metal is disposed in said gap electrically connecting said two paired electrodes by contacting each of said paired electrodes and one of said paired electrodes is said body.

22. A thermosensor according to claim 1, wherein said elastic member is a metal, and forms a part of a conduction path.

23. A thermoprotector comprising a thermosensor according to claim 22, wherein paired electrodes are disposed with a gap in between, said elastic metal is disposed in said gap electrically connecting said paired electrodes by contacting each of said paired electrodes and one of said paired electrodes is said body.

24. A thermoprotector wherein said thermoprotector has a stationary electrode and a movable electrode, and a thermosensor according to claim 1 is incorporated so that said movable electrode is contacted with said stationary electrode by an operation of said thermosensor.

25. A method of producing a thermosensor according to claim 1, wherein one end portion of a wide elastic member material is face joined to a wide body material via a fusible material, said joined member is cut into many strips and said elastic member piece is folded back with setting said face joined portion as a boarder, or said elastic member material is folded back with setting said face joined portion as a boarder and said joined member is cut into many strips, and thereafter another end portion of said elastic member piece is fixed to a body at a flexure angle of zero in a state where said folded elastic member piece is compressed in a longitudinal direction.

26. A thermosensor comprising: an elastic member which is fixed to a body, both ends of said elastic member being fixed to said body in a state where said elastic member is compressed in a longitudinal direction, to form said elastic member into a convex curved shape, one end side of the convex curved shape being raised by a predetermined angle with respect to said body, a flexure angle of an other end of the convex curved shape being zero; and a fusible material which fixes one end portion of said elastic member and said body together, a melting point or a softening point of said fusible material being an operating temperature;

wherein one end portion of said elastic member is inward folded, and an inner side face of a folded piece is face joined to a rear face of a tip end portion of said body via said fusible material.

27. A thermosensor according to claim 26, wherein said elastic member is a metal, a composite material of a metal and a resin, or a polymer.

28. A thermoprotector wherein said thermoprotector has a stationary electrode and a movable electrode, and a thermosensor according to claim 27 is incorporated so that said movable electrode is contacted with said stationary electrode by an operation of said thermosensor.

29. A thermosensor according to claim 27, wherein said elastic member is a metal, and forms a part of a conduction path.

30. A thermoprotector comprising a thermosensor according to claim 29, wherein paired electrodes are disposed with a gap in between, said elastic metal is disposed in said gap electrically connecting said paired electrodes by contacting each of said paired electrodes and one of said paired electrodes is said body.

31. A thermosensor according to claim 27, wherein said fusible material is a thermoplastic resin.

32. A thermoprotector wherein said thermoprotector has a stationary electrode and a movable electrode, and a thermosensor according to claim 31 is incorporated so that said movable electrode is contacted with said stationary electrode by an operation of said thermosensor.

33. A thermosensor according to claim 31, wherein said elastic member is a metal, and forms a part of a conduction path.

34. A thermoprotector comprising a thermosensor according to claim 33, wherein paired electrodes are disposed with a gap in between said elastic metal is disposed in said gap electrically connecting said paired electrodes by contacting each of said paired electrodes and one of said paired electrodes is said body.

35. A thermosensor according to claim 27, wherein said fusible material is a low-melting point metal.

36. A thermoprotector wherein said thermoprotector has a stationary electrode and a movable electrode, and a thermosensor according to claim 35 is incorporated so that said movable electrode is contacted with said stationary electrode by an operation of said thermosensor.

37. A thermosensor according to claim 35, wherein said elastic member is a metal, and forms a part of a conduction path.

38. A thermoprotector comprising a thermosensor according to claim 37, wherein paired electrodes are disposed with a gap in between, said elastic metal is disposed in said gap electrically connecting said paired electrodes by contacting each of said paired electrodes.

39. A thermosensor according to claim 26, wherein said fusible material is a low-melting point metal.

40. A thermoprotector wherein said thermoprotector has a stationary electrode and a movable electrode, and a thermosensor according to claim 39 is incorporated so that said movable electrode is contacted with said stationary electrode by an operation of said thermosensor.

41. A thermosensor according to claim 39, wherein said elastic member is a metal, and forms a part of a conduction path.

42. A thermoprotector comprising a thermosensor according to claim 41, wherein paired electrodes are disposed with a gap in between, said elastic metal is disposed in said a electrically connecting said paired electrodes by contacting each of said paired electrodes and one of said paired electrodes is said body.

43. A thermosensor according to claim 26, wherein said fusible material is a thermoplastic resin.

44. A thermoprotector wherein said thermoprotector has a stationary electrode and a movable electrode, and a thermosensor according to claim 43 is incorporated so that said movable electrode is contacted with said stationary electrode by an operation of said thermosensor.

45. A thermosensor according to claim 43, wherein said elastic member is a metal, and forms a part of a conduction path.

46. A thermoprotector comprising a thermosensor according to claim 45, wherein paired electrodes are disposed with a gap in between, said elastic metal is disposed in said gap electrically connecting said paired electrodes by contacting each of said paired electrodes and one of said paired electrodes is said body.

47. A thermosensor according to claim 26, wherein said elastic member is a metal, and forms a part of a conduction path.

48. A thermoprotector comprising a thermosensor according to claim 47, wherein paired electrodes are disposed with a gap in between, said elastic metal is disposed in said gap electrically connecting said paired electrodes by contacting each of said paired electrodes and one of said paired electrodes is said body.

49. A thermoprotector wherein said thermoprotector has a stationary electrode and a movable electrode, and a thermosensor according to claim 26 is incorporated so that said movable electrode is contacted with said stationary electrode by an operation of said thermosensor.

50. A method of producing a thermosensor according to claim 26, wherein one end portion of a wide elastic member material is face joined to a rear face of a tip end portion of a wide body material via a fusible material, said joined member is cut into many strips and said elastic member piece is folded back toward a surface of a body, or said elastic member material is folded back toward a surface of said body material and said joined member is cut into many strips, and thereafter another end portion of said elastic member piece is fixed to said body at a flexure angle of zero in a state where said folded elastic member piece is compressed in a longitudinal direction.

51. A thermoprotector having a thermosensor, said thermosensor comprising: an elastic member which is fixed to a body, both ends of said elastic member being fixed to said body in a state where said elastic member is compressed in a longitudinal direction, to form said elastic member into a convex curved shape, one end side of the convex curved shape being raised by a predetermined angle with respect to said body, a flexure angle of an other end of the convex curved shape being zero; and a fusible material which fixes one end portion of said elastic member and said body together, a melting point or a softening point of said fusible material being an operating temperature;

wherein said thermoprotector further comprises a stationary electrode and a movable electrode, and a thermosensor, where said movable electrode is contacted with said stationary electrode by an operation of said thermosensor.

52. A thermoprotector having a stationary electrode and a movable electrode, and a thermosensor;

said thermosensor comprises: an elastic member being a metal, a composite material of a metal and a resin, or a polymer, which is fixed to a body, both ends of said elastic member being fixed to said body in a state where said elastic member is compressed in a longitudinal direction, to form said elastic member into a convex curved shape, one end side of the convex curved shape being raised by a predetermined angle with respect to said body, a flexure angle of an other end of the convex curved shape being zero; and a fusible material which fixes one end portion of said elastic member and said body together, a melting point or a softening point of said fusible material being an operating temperature;

wherein said movable electrode is contacted with said stationary electrode by an operation of said thermosensor.

53. A thermoprotector having a stationary electrode and a movable electrode, and a thermosensor;

said thermosensor comprises: an elastic member which is fixed to a body, both ends of said elastic member being fixed to said body in a state where said elastic member is compressed in a longitudinal direction, to form said elastic member into a convex curved shape, one end side of the convex curved shape being raised by a predetermined angle with respect to said body, a flexure angle of an other end of the convex curved shape being zero; and a fusible material of low-melting point metal which fixes one end portion of said elastic member and said body together, a melting point or a softening point of said fusible material being an operating temperature;

wherein said movable electrode is contacted with said stationary electrode by an operation of said thermosensor.

54. A thermoprotector having a stationary electrode and a movable electrode, and a thermosensor;

said thermosensor comprises: an elastic member being a metal, a composite material of a metal and a resin, or a polymer, which is fixed to a body, both ends of said elastic member being fixed to said body in a state where said elastic member is compressed in a longitudinal direction, to form said elastic member into a convex curved shape, one end side of the convex curved shape being raised by a predetermined angle with respect to said body, a flexure angle of an other end of the convex curved shape being zero; and a fusible material of low-melting point metal which fixes one end portion of said elastic member and said body together, a melting point or a softening point of said fusible material being an operating temperature;

wherein said movable electrode is contacted with said stationary electrode by an operation of said thermosensor.

55. A thermoprotector having a stationary electrode and a movable electrode, and a thermosensor;

said thermosensor comprises: an elastic member which is fixed to a body, both ends of said elastic member being fixed to said body in a state where said elastic member is compressed in a longitudinal direction, to form said elastic member into a convex curved shape, one end side of the convex curved shape being raised by a predetermined angle with respect to said body, a flexure angle of an other end of the convex curved shape being zero; and a fusible material of a thermoplastic resin which fixes one end portion of said elastic member and said body together, a melting point or a softening point of said fusible material being an operating temperature;

wherein said movable electrode is contacted with said stationary electrode by an operation of said thermosensor.

56. A thermoprotector having a stationary electrode and a movable electrode, and a thermosensor;

said thermosensor comprises: an elastic member being a metal, a composite material of a metal and a resin, or a polymer, which is fixed to a body, both ends of said elastic member being fixed to said body in a state where said elastic member is compressed in a longitudinal direction, to form said elastic member into a convex curved shape, one end side of the convex curved shape being raised by a predetermined angle with respect to said body, a flexure angle of an other end of the convex curved shape being zero; and a fusible material of a thermoplastic resin which fixes one end portion of said elastic member and said body together, a melting point or a softening point of said fusible material being an operating temperature;

wherein said movable electrode is contacted with said stationary electrode by an operation of said thermosensor.

* * * * *